US005610641A

United States Patent [19]

Ikado

[11] Patent Number: 5,610,641

[45] Date of Patent: Mar. 11, 1997

[54] COLOR INK JET PRINTING APPARATUS HAVING A WIPER SUITED FOR DIFFERING COLOR INK PROPERTIES

[75] Inventor: Masaharu Ikado, Suita, Japan

[73] Assignee: Canon Kabushiki Kaisha, Tokyo, Japan

[21] Appl. No.: 340,895

[22] Filed: Nov. 15, 1994

[30] Foreign Application Priority Data

Nov. 16, 1993 [JP] Japan ..... 5-286764

[51] Int. Cl.[6] ..... B41J 2/165

[52] U.S. Cl. ..... 347/33; 347/24

[58] Field of Search ..... 347/22, 24, 33, 347/43

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,463,359 | 7/1984 | Ayata et al. | 347/56 |
| 4,723,129 | 2/1988 | Endo et al. | 347/56 |
| 4,740,796 | 4/1988 | Endo et al. | 347/56 |
| 5,103,244 | 4/1992 | Gast et al. | 347/33 |
| 5,151,715 | 9/1992 | Ward et al. | 347/33 |

FOREIGN PATENT DOCUMENTS

| | | | |
|---|---|---|---|
| 446885 | 9/1991 | European Pat. Off. | 347/33 |
| 62-101448 | 5/1987 | Japan . | |
| 5-104734 | 4/1993 | Japan | 347/33 |
| 6-71904 | 3/1994 | Japan | 347/33 |

*Primary Examiner*—John E. Barlow, Jr.

*Attorney, Agent, or Firm*—Fitzpatrick, Cella, Harper & Scinto

[57] ABSTRACT

In an ink jet apparatus of the type which includes an ink jet head having a plurality of ejection openings for ejecting ink and adapted to print by ejecting ink from the ejection openings onto a print material, a carrying device carrying the ink jet head and provided such that it is movable in main scanning directions for the print material, and a cleaning device for cleaning that surface of the ink jet head on which the ejection openings are provided by abutting against this surface as the carrying device moves along, the cleaning device is a cleaning blade adapted to generate different abutting forces with respect to that surface of the ink jet head on which the ejection openings are provided. With this ink jet apparatus, it is possible to reduce the amount of ink left unwiped on the ejection surfaces of various types of ink jet heads, thereby realizing a high-quality-printing ink jet apparatus that is free from defective ink ejection, color mixing or the like.

9 Claims, 6 Drawing Sheets

FIG. 1(a)
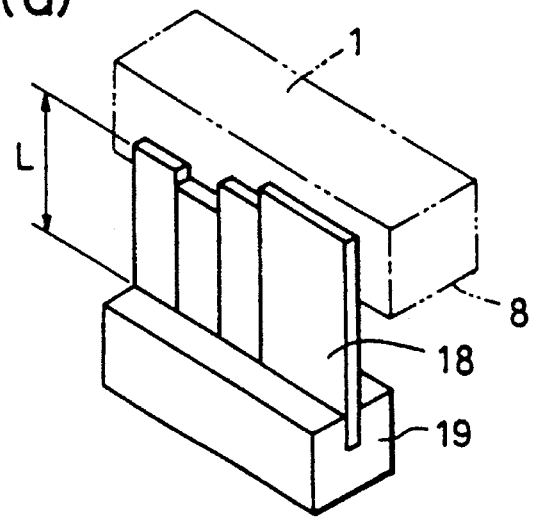
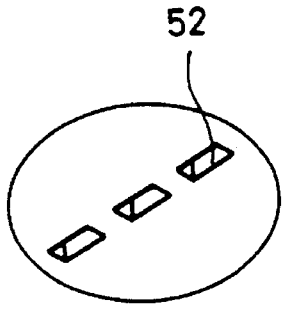
FIG. 1(c)
FIG. 1(b)
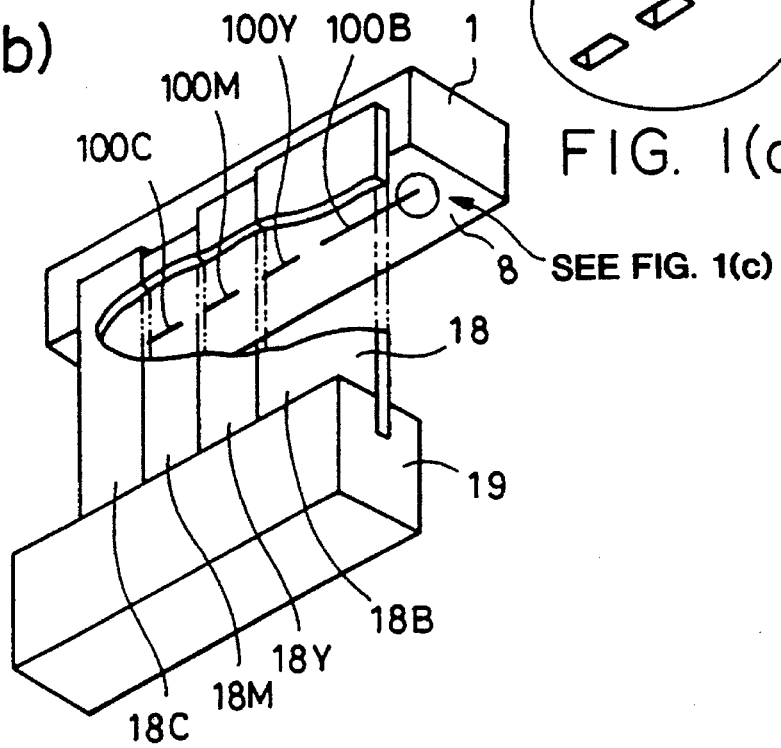
FIG. 1(d)
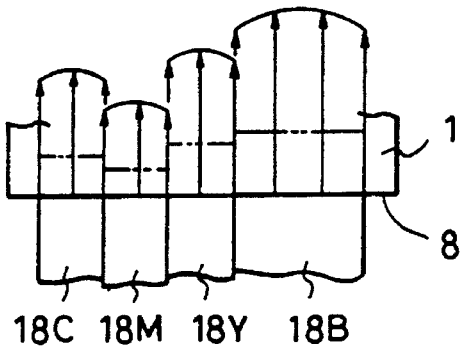

COLOR INK JET PRINTING APPARATUS HAVING A WIPER SUITED FOR DIFFERING COLOR INK PROPERTIES

BACKGROUND OF THE INVENTION

1. Field of the Invention

The present invention relates to an ink jet apparatus that prints by ejecting ink from ejection openings of an ink jet head and causing the ink to adhere to a material on which printing is to be effected (hereinafter referred to as "print material"). In particular, the present invention relates to an ink jet apparatus that is equipped with a wiping device that wipes that surface of the ink jet head on which the ejection openings are formed (hereinafter referred to as the "ejection surface") in order to enable the ink jet head to maintain a stable ink ejecting function.

2. Description of the Related Art

A printing apparatus having the function of a printer, copying machine, facsimile apparatus or the like, or a printing apparatus used as the output apparatus of a composite-type electronic apparatus including a computer, word processor and the like, or a printing apparatus used as the output apparatus of a work station, is designed such that images are successively printed on a print material consisting of a printing medium, such as paper or a thin plastic plate. Depending on the printing method, such printing apparatuses can be classified into ink jet type apparatuses, wire dot type apparatuses, thermal type apparatuses, laser beam type apparatuses, etc.

In a serial-type printing apparatus, a serial scanning system is employed, in which the main scanning is performed in a direction that crosses the print material conveying direction, which is the sub-scanning direction for the print material. In this serial-type printing apparatus, the print material is set at a predetermined printing position, and then an image portion corresponding to one line is printed on the print material through the main scanning by a printing device mounted on a carriage that is movable along the print material. After the completion of the printing of the above image portion, corresponding to one line, a paper feeding process called "pitch feed" is performed to feed the print material by a predetermined amount. After this, the printing of an image portion corresponding to the next line is performed on the print material, which is at rest. By repeating this series of operations, printing is effected on the entire print material. In a line-type printing apparatus, which prints solely by sub-scanning, performed in the print material feeding direction, the print material is set at a predetermined printing position, and the printing of an image portion corresponding to one line is collectively effected. After this, the print material is fed by a predetermined amount, and then the printing of an image portion corresponding to the next line is collectively effected. By repeating these operations, printing is performed on the entire print material.

Of the printing apparatuses mentioned above, the ink jet printing apparatus employing an ink jet system in which ink is ejected from the printing device to the print material provides various advantages. For example, the ink jet printing apparatus can be easily built in a small size. Further, with the ink jet printing apparatus, it is possible to print a high-resolution image at high speed. The ink jet printing apparatus allows printing on an ordinary paper without requiring any special processing for the paper, and requires a low running cost. Further, due to its non-impact system, it is relatively free from noises. In addition, it enables a color image to be easily printed by using inks of different colors. In particular, when the ink jet printing apparatus is a line type printing apparatus that uses a line type printing device in which a multitude of ejection openings are arranged along the paper direction, a further increase in printing speed is possible.

In particular, an ink jet printing apparatus of a type which ejects ink by utilizing heat energy can be easily produced as a printing apparatus exhibiting a high-density liquid passage arrangement. Such a high-density liquid passage arrangement can be realized by forming electro-thermal converters, electrodes, liquid passage walls, top plates, etc. through film formation on a substrate by using a semiconductor manufacturing process, such as etching, evaporation, or sputtering. This arrangement allows a further reduction in size. Regarding the print material, various requirements should be taken into consideration. Apart from the ordinary print materials, such as paper and thin plastic plates (OHP or the like), use of thin paper or processed paper (e.g., paper with punch holes or perforation for filing or paper with an arbitrary configuration) has recently come to be required.

FIG. 8 is a schematic diagram illustrating the positional relationship between the ink jet head, carriage and cleaning blade in a conventional ink jet apparatus.

In FIG. 8, numeral 1 indicates an ink jet head that is integrally combined with an ink tank to form an ink jet cartridge. The ink jet head 1 is carried by a carriage 2 that is slidably mounted on a guide rail 3. The ink jet head 1 is equipped with a plurality of ejection openings, and ejects ink from the plurality of ejection openings as it reciprocates with the carriage 2 in the main scanning directions indicated by the arrows S, thereby performing printing. The carriage 2 further carries a carriage spur (not shown), which is mounted on the carriage 2 at a position in the vicinity of the ink jet head 1. The carriage spur is rotatably mounted such that, when brought into contact with the print material, the carriage spur is displaced while rolling on the print material as the carriage 2 reciprocates. Due to this arrangement, the minimum requisite gap is ensured between the print material and the ink jet head 1 even when the print material is deflected to exhibit a local swell. In this way, the print material is kept from coming into contact with the ink jet head 1.

A cleaning blade 18 cleans the ejection surface of the ink jet head 1. The cleaning blade 18 is formed as a one-piece plate of urethane rubber, HNBR or the like and has a thickness of, for example, 0.5 mm. When cleaning is performed, the cleaning blade 18 is positioned such that it overlaps the ejection surface of the ink jet head 1 to wipe away paper powder, dust, residuary ink and the like adhering to the ejection surface when the ink jet head 1, mounted on the carriage 2, passes the cleaning blade 18. During the preparation of the ink jet head 1, its ejection surface is subjected to surface treatment such that the ejection surface exhibits a uniform ink wettability.

Due to the fact that the ejection surface is wiped with a one-piece cleaning blade, the above-described conventional ink jet apparatus cannot sufficiently cope with such problems as unevenness in the ink wettability of the ejection surface or unevenness in the pressure distribution of the cleaning blade, resulting in some residuary ink being allowed to remain unwiped. This problem is particularly conspicuous when the ejection surface has some surface irregularities or when the ink jet apparatus is a color type ink jet apparatus in which the nozzle of an ink jet head is divided into several parts that are respectively supplied with inks of different colors.

Japanese Patent Laid-Open No. 62-101448 discloses a construction in which the blade forward-end portion is separated into a plurality of parts and in which the divisional widths are varied in accordance with the head configuration. However, even with this construction, it is not always possible to solve the above problem. In the above-mentioned color-type ink jet head, in particular, in which the ink composition differs from color to color, the problem of some residuary ink being allowed to remain unwiped and the problem of the surface-treated ejection surface being worn are conspicuous. Further, defective ink ejection is also to be observed. Furthermore, there is a problem of color mixing, i.e., mixing of inks of different colors in the nozzle section. Under the circumstances, there is a demand for an improvement in printing quality.

SUMMARY OF THE INVENTION

In view of the above problems in the prior art, it is an object of the present invention to provide an ink jet apparatus equipped with a cleaning blade that is capable of reducing the amount of residuary ink allowed to remain unwiped on the ejection surface of the ink jet head.

Another object of the present invention is to provide an ink jet apparatus having a color-type ink jet head which is free from defective ink ejection or color mixing, thereby providing an excellent printing quality.

To achieve this object, according to the present invention, there is provided an ink jet apparatus of the type which includes an ink jet head having a plurality of ejection openings for ejecting ink and adapted to print by ejecting ink from the ejection openings onto a print material, carrying means carrying the ink jet head and provided such that it is movable in main scanning directions for the print material, and cleaning means for cleaning that surface of the ink jet head on which the ejection openings are provided by abutting against the surface as the carrying means moves along, wherein the cleaning means is a cleaning blade adapted to generate partly different abutting forces with respect to that surface of the ink jet head on which the ejection openings are provided.

BRIEF DESCRIPTION OF THE DRAWINGS

FIGS. 1(*a*) through 1(*d*) are diagrams illustrating a cleaning blade according to a first embodiment of the present invention;

DESCRIPTION OF THE PREFERRED EMBODIMENTS

The present invention will now be described in detail with reference to the drawings.

FIG. 1(*a*) a perspective view from above of a cleaning blade according to the first embodiment of the present invention. FIG. 1(*b*) is a perspective view from below of the cleaning blade according to the first embodiment of the present invention with FIG. 1(*c*) an enlarged view of a portion thereof. FIG. 1(*d*)is a diagram showing the distribution of the abutting force of the cleaning blade of the first embodiment of the present invention with respect to the ejection surface of the ink jet head.

Figure 2:
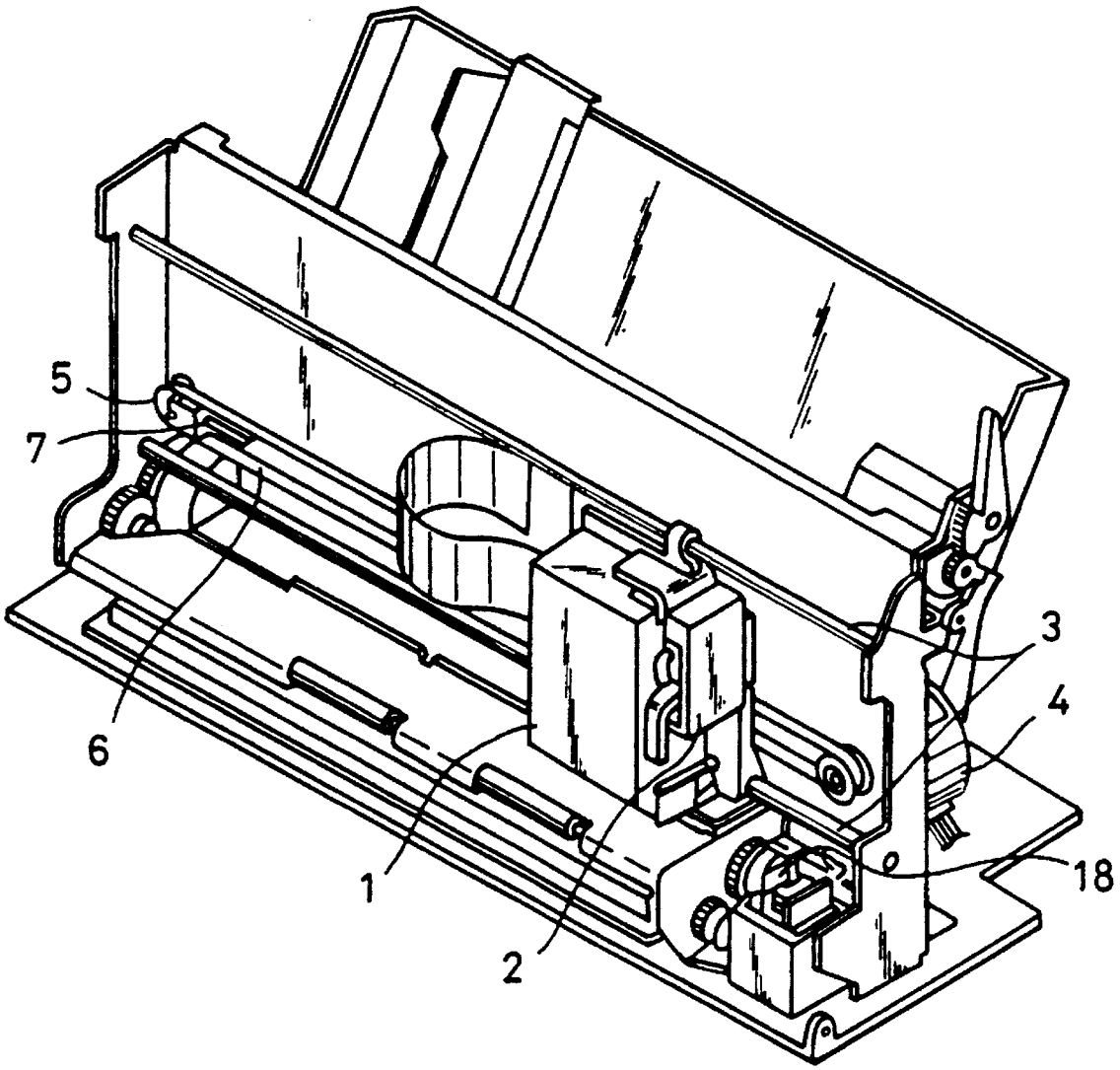
FIG. 2 is an overall view of an ink jet apparatus according to the present invention.

FIG. 2 is an overall view of an ink jet head according to the present invention.

In FIG. 2, an ink jet head 1 is mounted on a carriage 2. The carriage 2 is supported by two guide rails 3 such that it can reciprocate on the rails 3. A carriage motor 4 for moving the carriage 2 is provided at one end of the apparatus body. At the other end of the apparatus body, an idler pulley 5 is provided. A timing belt 6 that is parallel to the guide rails 3 is stretched between the carriage motor 4 and the idler pulley 5, with a part of the timing belt 6 being connected to the carriage 2. Further, the timing belt 6 is endowed with a predetermined tension by a tension spring 7 provided adjacent to the idler pulley 5. By the normal and reverse rotations of the carriage motor 4, the carriage 2 is reciprocated, and, by the amount of rotation of the carriage motor 4, the position of the carriage 2 (i.e., the position of the ink jet head 1) is controlled.

The ink jet apparatus of the present invention comprises a printing device for printing by ejecting ink onto a print material, a moving device for moving the printing device, and a cleaning device for wiping the ink ejecting section of the printing device. The cleaning device consists of a cleaning blade 18 which abuts against an ejection surface 8 of the ink jet head 1 with partly different abutting forces. Specifically, as shown in FIGS. 1(*a*) and 1(*b*), the cleaning blade 18 is arranged in the path of reciprocation of the ink jet head 1 such that the cleaning blade 18 overlaps a part of the ejection surface 8. The ejection surface 8 has ejection openings 52 through which ink is ejected, as shown in FIG. 1(*c*). Numeral 100B indicates a black-ink ejection-hole group for printing in black which consists sixty-four ejection openings 52 arranged in a row and filled with black ink. Numeral 100Y indicates a yellow-ink ejection-hole group for printing in yellow which consists of twenty-four ejection openings 52 arranged in a row and filled with yellow ink. Similarly, numeral 100M indicates a magenta-ink ejection-hole group, and numeral 100C indicates a cyan-ink ejection-hole group. The four kinds of ink, black, yellow, magenta and cyan, which are respectively ejected from the above-mentioned ejection-hole groups to effect color printing on a print material, are liquids whose physical properties are inevitably different due to the difference in the pigments used for coloring. Thus, the physical properties of the residuary ink adhering to the ejection surface 8 in the course of printing (by, for example, being splashed back from the print material) are also different depending on the ejection-hole group from which the ink was ejected.

The physical properties of an ink vary according to its composition. Thus, the values of the physical properties of an ink are not to be defined without specifying its composition. However, for purposes of illustration, it will be assumed that the viscosities of the four inks are in the following order: B (black)>Y (yellow)>C (cyan)>M (magenta) (i.e., the viscosity of B, for example, is higher than that of Y). In that case, the respective viscosities of the residuary inks adhering to those areas of the ejection surface which are around the respective ejection-hole groups are also in the order: B>Y>C>M. The higher the viscosity of an ink, the more energy it requires before it can be wiped away. Thus, the requisite forces with which wiping is to be performed on the four ejection-hole groups are in the following order: 100B>100Y>100C >100M. When the cleaning of the ejection surface is to be performed with a single cleaning blade as in the prior art, the requisite force for cleaning must be set in accordance with the requirement of the ejection-hole group 100B, which requires the maximum cleaning force. Thus, the cyan ejection opening group 100C, for example, is wiped with an excessive force, so that the ejection openings 2 are worn away, resulting in the service life of the head being shortened.

In the present invention, the cleaning blade 18 is divided into four blade sections of 18B, 18Y, 18M and 18C in correspondence with the respective widths of the ejection opening groups 100B, 100Y, 100M and 100C. The respective free-end-portion lengths L of these four blade sections are set to be in the following order: 18B>18Y>18C>18M, so that the respective overlapping amounts of these blade sections with respect to the ejection surface 8 are also in the order: 18B>18Y>18C>18M. The abutting force with respect to the ejection surface 8 naturally becomes larger in proportion to the overlapping amount. This relationship is illustrated in FIG. 1(*d*). As can be seen from the drawing, the cleaning blade is designed such that the larger the requisite cleaning energy for an ejection opening group, the larger the abutting force generated. Here, the abutting force (in other words, the overlapping amount) of a blade section (for example, 18B) is not uniform in the entire blade section but gradually diminishes toward the ends of the blade section. This is a situation to be accounted for in terms of pure dynamics, and is not particularly intentional. That is, the central portion of a blade section, which is solid on both sides, abuts with a relatively large force, whereas each end portion of the blade section is solid only on one side (i.e., the inner side). That is why the abutting force gradually diminishes toward the ends of the blade section.

Regarding the service life of the ejection openings 52, it should also be noted that the higher the viscosity of an ink, the higher the performance of the ink as lubricant (due to the higher film surface), which means strong wiping of an ejection opening group does not necessarily lead to deterioration in the durability of the ejection opening group.

The optimum respective overlapping amounts of the blade sections are obtained experimentally or by calculation. Regarding the material of each cleaning blade 18, it can be appropriately selected in accordance with the compatibility with the properties of the ink. Examples of the material of for each cleaning blade 18 include NBR, HNBR, silicon rubber, urethane rubber, polyethylene, and nylon.

While in the above description attention was focused on the differences in the physical properties of the inks, the present invention is also effective when considered from the the following point of view: in the case of the ink jet head 1 which, as shown in FIG. 1(*b*), has a plurality of ejection opening groups 100 for respectively ejecting inks of different colors, the residuary ink of one color, e.g., black, adhering to the ejection surface 8, may flow on the ejection surface 8 to reach the ejection opening group of another color, for example, yellow (the ejection opening group 100Y), with the result that mixing of yellow and black occurs, thereby making it impossible to perform printing in the correct color. To solve this problem, the free-end-portion length of the cleaning blade section for the ejection opening group for the most intense color (which is black in this case), i.e., the black ink ejection opening group 100B, is increased, thereby enabling the ejection surface portion for the black ink to be cleaned more reliably to reduce the possibility of color mixing.

When color printing is performed by using a plurality of inks (black, yellow, magenta, cyan and the like), as in this embodiment, the respective used amounts of the inks naturally differ depending upon the kind of image to be printed. Generally speaking, it is characters that are most often printed (i.e., printing in black). Therefore, the amount of residuary ink sticking to the area of the ejection surface around the black ink ejection opening group 100B is the largest. Further, in ink jet color recording, it is the general practice to make the ejection amount of black ink larger than that of the yellow, magenta or cyan ink so that the recording density of the printing in black ink can be larger. In these cases, the arrangement of this embodiment proves effective since it enables the ejection opening group 100B to be wiped with a relatively large force.

Figure 4A:
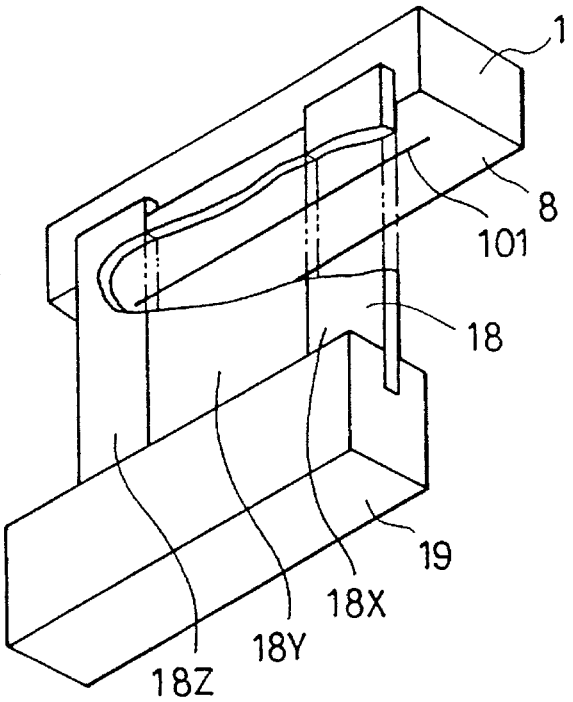
FIGS. 4(*a*) through 4(*c*) are diagrams showing a cleaning blade according to a second embodiment of the present invention.
Figure 4B:
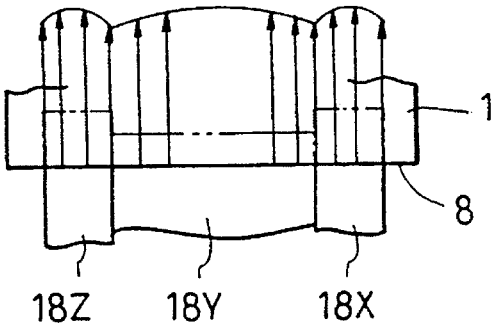
Figure 4C:
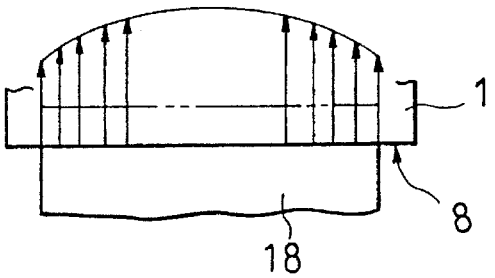

FIG. 4(*a*) is a perspective view from below of the second embodiment of the present invention, and FIG. 4(*b*) is a diagram showing the distribution of the force with which the cleaning blade 18 abuts against the ejection surface 8. FIG. 4(*c*) is a diagram showing the abutting force distribution in the prior art. Referring to FIG. 4(*a*), an ejection opening group 101, in which 128 or 256 ejection openings 52 are arranged side by side, is provided on the ejection surface 8. In this case, only one kind of ink, e.g., black ink, is used. In this arrangement, the problem of the difference in cleaning conditions due to the difference in the physical properties of inks and the problem of color mixing, as described with reference to the first embodiment, are not entailed. Recently, however, the number of ejection openings 52 is increasing for the purpose of attaining an improvement in terms of printing speed. In the above-mentioned case, where 256 ejection openings 52 are arranged, the length of the ejection opening group 101 is 18 mm assuming that 360 ejection openings per inch are arranged. When this length is to be covered with a one-piece cleaning blade 18, as in the prior art, the distribution of the force with which the cleaning blade abuts against the ejection surface 18 is as shown in FIG. 4(*c*). As can be seen from the diagram, the abutting force is distributed such that the force gradually diminishes toward the ends of the cleaning blade. The reason for this distribution is the same as described with reference to the first embodiment. In this case, however, the difference in force between the central and the end portions of the cleaning blade is larger since the width of the one-piece cleaning blade is larger than the width of the individual blade section in the above-described case. Thus, the cleaning conditions cannot be uniformalized. In view of this problem, this embodiment employs an arrangement in which the cleaning blade 18 is divided into three sections of 18X, 18Y and 18Z, wherein the free-end-portion lengths of the side sections 18X and 18Z are set larger than that of the central section 18Y. As a result, an abutting force distribution as shown in FIG. 4(*b*) is obtained, in which the abutting force distribution is uniformalized, making it possible to set a uniform cleaning condition over the entire length of the ejection opening group 101. The widths of the divisional blade sections and the free-end-portion lengths thereof are determined experimentally or by calculation.

Figure 3:
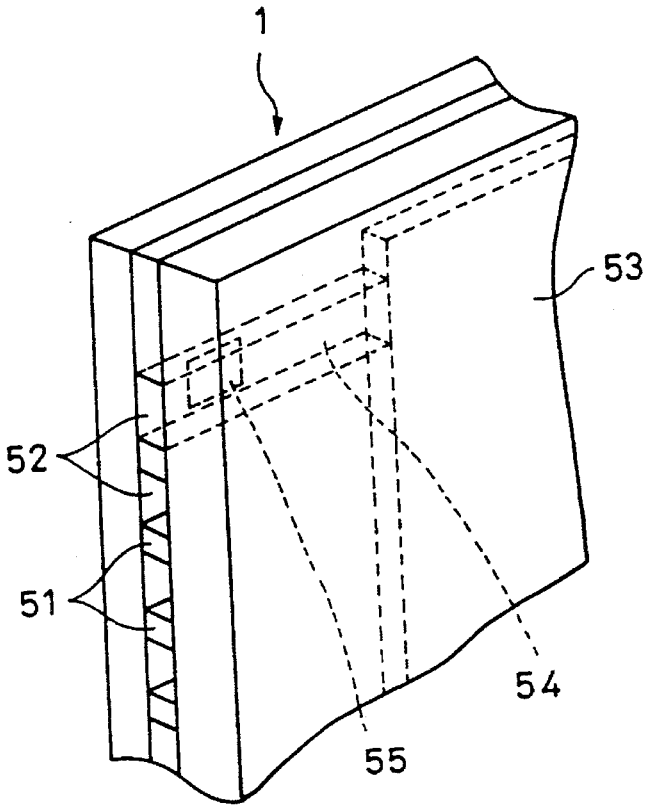
FIG. 3 is a partial perspective view schematically illustrating the structure of the ink ejecting section of the ink jet head of an ink jet apparatus according to the present invention.

FIG. 3 is a partial perspective view schematically showing the structure of the ink ejecting section of the ink jet head 1. In FIG. 3, a plurality of ejection openings 52 are formed at a fixed pitch on an ejection surface 51, which faces the print material with a predetermined gap (which is for example, approximately 0.5 to 2.0 mm). The ejection openings 52 communicate with a common liquid chamber 53 through liquid passages 54. An electro-thermal converter (heat generating resistors or the like) 55 for generating energy for ejecting ink is arranged in each liquid passage 54 to extend along the inner surface thereof. In this embodiment, the ink jet head 1 is mounted on the carriage 2 such that the ejection openings 52 are arranged along a dimension crossing the scanning directions of the carriage 2. On the basis of an image signal or ejection signal supplied, the corresponding electro-thermal converter 55 is driven (energized) to cause film boiling in the ink in the liquid passage 54, thereby generating a pressure. This pressure causes ink to be ejected from the ejection opening 52.

This embodiment is also applicable to an ink jet head of any other type than the above ink jet head 1. For example, the ink jet head may be a cartridge type, in which an ink jet head and an ink tank are combined into an integral unit, or a type in which the ink jet head and the ink tank are formed as separate components connected together through an ink supply tube. The effect of this embodiment is the same with respect to whatever type of ink jet head it is applied.

The present invention is applicable to any type of ink jet apparatus. For example, the present invention is applicable to an ink jet apparatus using an ink jet head employing electro-mechanical converters like piezoelectric elements. Above all, the present invention provides an excellent effect when applied to an ink jet apparatus of a type in which ink is ejected by utilizing heat energy since, with such an ink jet head, a high density and high resolution recording is possible.

Figure 5:
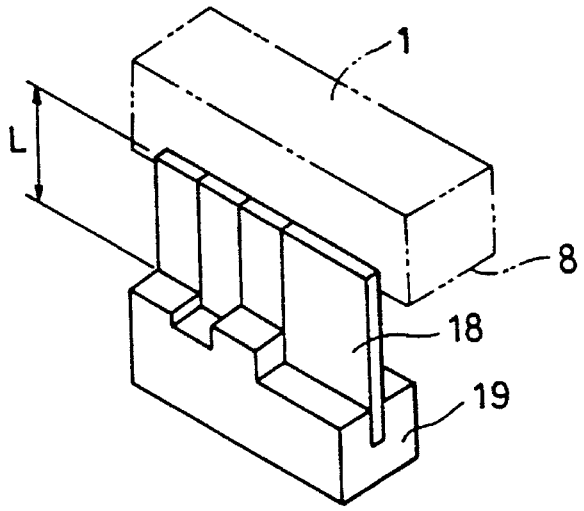
FIG. 5 is a diagram showing a cleaning blade according to a third embodiment of the present invention.
Figure 6:
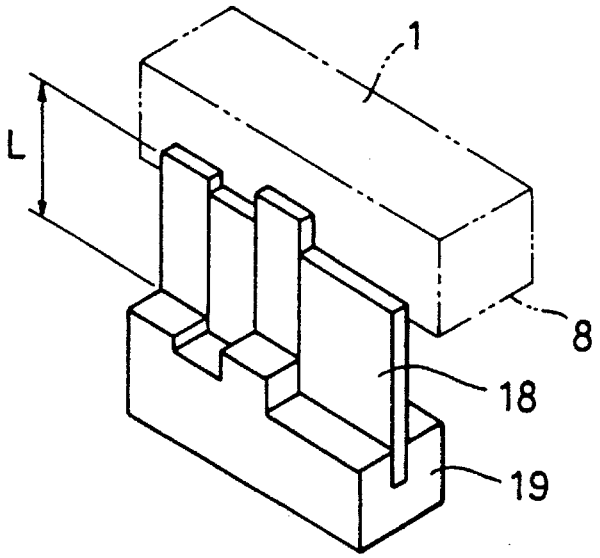
FIG. 6 is a diagram showing a cleaning blade according to a fourth embodiment of the present invention.

FIG. 6 is a diagram showing a cleaning blade according to the third embodiment of the present invention. As shown in the drawing, in this embodiment, the blade sections have the same free-end-portion length L but different overlapping amounts. FIG. 5 is a diagram showing a cleaning blade according to the fourth embodiment of the present invention. As shown in the drawing, in this embodiment, the blade sections have the same overlapping amount but different free-end-portion lengths L. The free-end-portion length L can be freely varied by appropriately adjusting the blade holding member 19.

Figure 7:
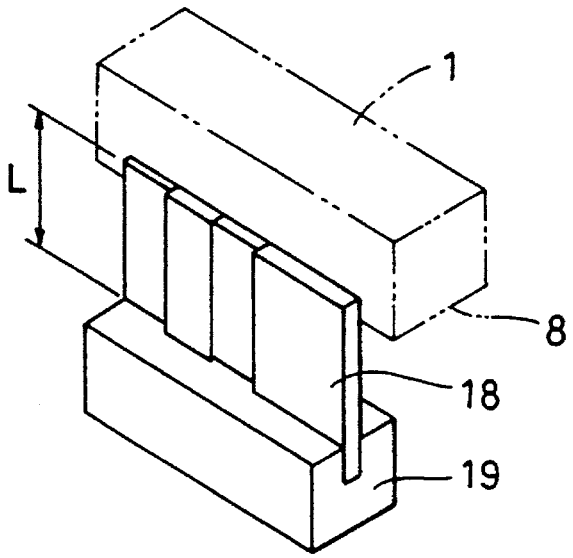
FIG. 7 is a diagram showing a cleaning blade according to a fifth embodiment of the present invention.
Figure 8:
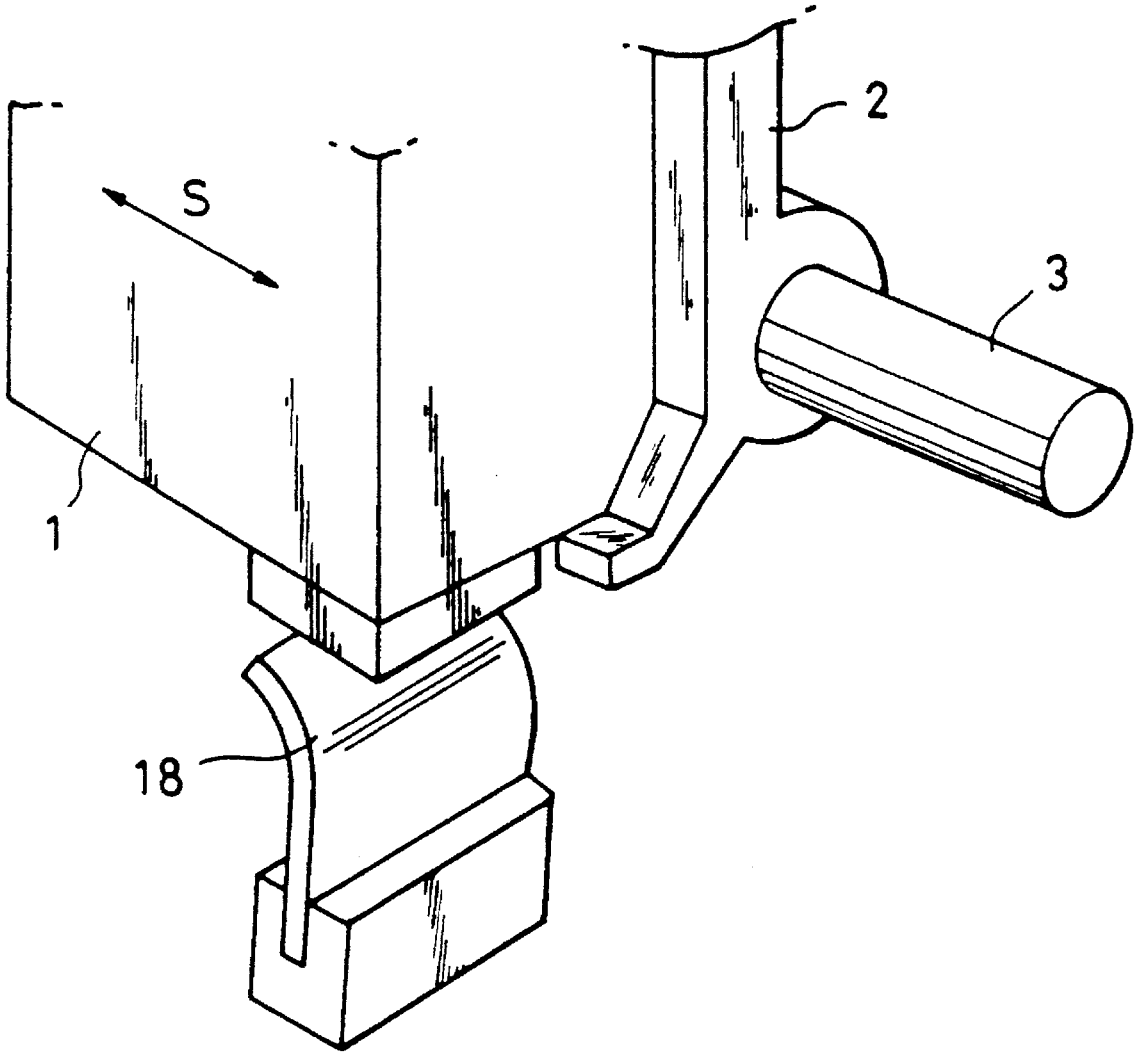
FIG. 8 PRIOR ART
FIG. 8 is a diagram showing the ink jet head, carriage and cleaning blade of a conventional ink jet apparatus.

FIG. 7 is a diagram showing a cleaning blade according to the fifth embodiment of the present invention. As shown in the drawing, in this embodiment, the blade sections have different thicknesses. The overlapping amount and the free-end-portion length L can be arbitrarily set according to the characteristics of the ink jet head, as described above.

The present invention provides a particularly remarkable effect when applied to an ink jet head and ink jet apparatus based on an ink jet system which records by forming flying droplets by utilizing heat energy.

Typical examples of the construction and principle of this type of ink jet system are disclosed in U.S. Pat. Nos. 4.723,129 and 4,740,796. It is desirable to employ the basic principle as disclosed in the specifications of these patents. This ink jet system is equally applicable to what is called "on-demand" and "continuous" types. However, this ink jet system proves particularly effective when applied to an ink jet head of the on-demand type, in which at least one driving signal, corresponding to the print information and adapted to cause a rapid temperature rise beyond nucleate boiling, is applied to an electro-thermal converter arranged in a liquid (ink) holding sheet, a liquid passage or the like. This generates heat energy in the electro-thermal converter to cause film boiling on the heat action surface of the ink jet head, with the result that a bubble that is in one-to-one correspondence with this driving signal is formed in the liquid (ink). When this bubble grows in size or shrinks, liquid (ink) is ejected through the ejection opening, thereby forming at least one droplet. It is more preferable for this driving signal to be in a pulse form since that makes it possible for the bubble to grow or shrink quickly, thereby effecting a liquid (ink) ejection particularly excellent in responsiveness.

Suitable examples of this pulse-form driving signal are described in U.S. Pat. Nos. 4,463,359 and 4,345,262. Further, by adopting the conditions as disclosed in U.S. Pat. No. 4,313,124 regarding the temperature rise ratio of the above-mentioned heat acting surface, a still more excellent printing is possible.

Apart from the ink jet head structure as described in the above-mentioned patents, in which the ejection openings, liquid passages and electro-thermal converters are combined (to form linear or rectangular flow passages), the present invention also covers the ink jet head construction as disclosed in U.S. Pat. Nos. 4,558,333 and 4,459,600, in which the heat acting section is arranged in a bent region.

The present invention also proves effective when applied to the construction as disclosed in Japanese Patent Laid-Open No. 59-123670, in which a common slit is used as the ejecting section for a plurality of electro-thermal converters, or the construction as disclosed in Japanese Patent Laid-Open No. 59-138461, in which an opening for absorbing the pressure waves of heat energy is arranged opposite to the ejecting section.

Further, the above-described effect of the present invention can be obtained more effectively in the case of a full-line type ink jet head having a length corresponding to the width of the maximum print medium that allows the ink jet apparatus to print. Such a full-line type ink jet may consist of a combination of a plurality of ink jet heads as described in the above-mentioned patents or a single ink jet head formed as an integral unit.

Further, the present invention is also effective when applied to a replaceable, chip-type ink jet head which is electrically connected to the main unit and can be supplied with ink from the main unit when attached thereto, or a cartridge type ink jet head in which the ink jet head and the ink tank are formed as an integral unit.

It is desirable to add an ejection recovery means for the ink jet head, a preparatory auxiliary means and so on to the structure of the ink jet apparatus of the present invention since that helps to further stabilize the effect of the present invention. Examples of such additional means include a capping means, cleaning means, pressurizing or suction means, and preliminary heating means consisting of electro-thermal converters or some other types of heating elements or a combination of electro-thermal converters and such heating elements. Further, for stable recording, it is also effective to provide a preliminary ejection mode for effecting an ejection separately from recording.

Further, the present invention proves very effective when applied to an ink jet apparatus provided with not only the print mode using a main color, such as black, but also at least either a composite-color mode in which different colors are used or a full-color mode in which color mixing is effected on the print paper. In this case, the ink jet head may formed as a one-piece head or a combination of a plurality of heads.

Although in the above-described embodiments the ink was liquid, a solid ink can be employed as long as it is liquid when it is actually used, i.e., at the time of signal application. Thus, it is possible to use an ink which is solid at room temperature or below but softens or liquifies at a temperature higher than room temperature. In the above-described ink jet system, the ink is generally adjusted to be within a temperature range of from 30° C. to 70° C. so that the viscosity of the ink can be kept within a stable ejection range.

Further, the present invention is also applicable to a system in which temperature rise due to the generation of heat energy is prevented by utilizing the heat energy for changing the ink from the solid to the liquid state. It is also possible to use an ink which solidifies when left to stand so that it is prevented from evaporating. In any case, the present invention allows use of an ink that liquefies only when heat energy is applied thereto, for example, an ink which liquefies by heat energy imparted in accordance with a print signal before it is ejected as liquid ink, or an ink which is ejected as liquid ink but starts to solidify as soon as it reaches the print medium. In such cases, the ink may be held in recesses or through-holes of a porous sheet as liquid or solid and, in this condition, opposed to the electro-thermal converters. The present invention can be most effectively applied to these inks by executing the film boiling mentioned above.

In addition, the ink jet apparatus of the present invention may be formed as an integral or separate image output terminal of an image processing apparatus, such as a word processor or computer, or as a copying apparatus combined with a reader or the like, or, further, as a facsimile apparatus having transmitting and receiving functions.

What is claimed is:

1. An ink jet apparatus comprising:

an ink jet head having a plurality of ejection openings on a surface thereof for ejecting ink onto a print material, a cleaning blade supported in a cleaning blade holder for cleaning said surface generating abutting forces, and moving means for moving said blade relatively in abutting contact with respect to said surface, wherein said cleaning blade is divided into at least three abutting portions, and an end one of said abutting portions projects relative to an inner portion abutted against the end abutting portion and a free-end-portion length of the end abutting portion is larger than that of the inner abutting portion abutted against the end abutting portion.

2. An ink jet apparatus according to claim 1, wherein said abutting forces are predetermined depending upon the tint of the ink to be ejected.

3. An ink jet apparatus according to claim 1, wherein said abutting forces are predetermined depending upon the amount of the ink to be ejected.

4. An ink jet apparatus according to claim 1, further comprising carrying means for carrying said ink jet head, said carrying means being movable in main scanning directions for the print material, wherein said cleaning blade cleans said surface by abutting against said surface as said carrying means moves along, and said cleaning blade is adapted to abut against a black ink ejection section of said surface more strongly than against a color ink section of said surface.

5. An ink jet apparatus according to claim 1, wherein said cleaning blade is separated into a plurality of blade sections of different blade thicknesses.

6. An ink jet apparatus according to claim 1, wherein said cleaning blade is separated into a plurality of blade sections of different blade hardnesses.

7. An ink jet apparatus according to claim 1, wherein said cleaning blade is formed from a plurality of kinds of materials.

8. An ink jet apparatus according to claim 1, wherein said ink jet head includes black ejection openings for ejecting a black ink and color ejection openings for ejecting a color ink.

9. An ink jet apparatus according to claim 1, wherein said abutting forces are predetermined depending upon the physical properties of the ink to be ejected.

* * * * *

UNITED STATES PATENT AND TRADEMARK OFFICE

CERTIFICATE OF CORRECTION

PATENT NO. : 5,610,641

DATED : March 11, 1997

INVENTOR(S) : MASAHARU IKADO, ET AL.

It is certified that error appears in the above-identified patent and that said Letters Patent is hereby corrected as shown below:

COLUMN 4

Line 10, "1(d)is" should read --1(d) is--.

COLUMN 5

Line 53, "for" should be deleted.

COLUMN 7

Line 36, "third" should read --fourth--; and
Line 40, "fourth" should read --third--.

COLUMN 9

Line 5, "liquifies" should read --liquefies--; and
Line 37, "generating" should read --by generating--.

COLUMN 10

Line 3, "portion" should read --one of said abutting portions--.

Signed and Sealed this

Fourteenth Day of October, 1997

*Attest:*

*Attesting Officer*

Bruce Lehman

BRUCE LEHMAN

*Commissioner of Patents and Trademarks*